United States Patent [19]

Sizemore

[11] Patent Number: 4,682,461

[45] Date of Patent: Jul. 28, 1987

[54] SUPPORT FOR REINFORCING BAR

[75] Inventor: Billy G. Sizemore, West Carrollton, Ohio

[73] Assignees: Winston C. Sizemore, Franklin; Charles P. Sizemore, West Carrollton, both of Ohio ; part interest to each

[21] Appl. No.: 846,036

[22] Filed: Mar. 31, 1986

[51] Int. Cl.[4] ..... E04C 5/16

[52] U.S. Cl. ..... 52/689; 52/677

[58] Field of Search ..... 52/687, 688, 689, 682, 52/679, 678, 677

[56] References Cited

U.S. PATENT DOCUMENTS

| | | | |
|---|---|---|---|
| 2,275,105 | 3/1942 | Greulich | 52/667 |
| 4,085,559 | 4/1978 | Ilukowicz | 52/687 |
| 4,483,119 | 11/1984 | Hernandez | 52/689 |

FOREIGN PATENT DOCUMENTS

| | | | |
|---|---|---|---|
| 1484998 | 8/1969 | Fed. Rep. of Germany | 52/686 |
| 384379 | 8/1943 | France | 52/667 |
| 2118951 | 8/1972 | France | 52/687 |

*Primary Examiner*—Henry E. Raduazo
*Attorney, Agent, or Firm*—Harvey B. Jacobson; Clarence A. O'Brien

[57] ABSTRACT

A chair support for a concrete reinforcing bar is formed from smaller and larger molded plastic elements each in the form of a letter A with diverging legs, and upper cross member, and a lower cross member. The smaller element fits through the opening of the larger element and locks in place perpendicularly to the larger element by interengaging notches in the respective cross members.

5 Claims, 5 Drawing Figures

SUPPORT FOR REINFORCING BAR

BACKGROUND OF THE INVENTION

This invention relates to structures for use in supporting concrete reinforcing bars while the concrete is poured. Structures of this nature are well known and commonly referred to as "chairs". They are used, for example, in forming concrete slabs and the like where, for example, reinforcing bars are to be supported above a base surface onto which the concrete is poured to form a slab, so that the reinforcing bars become embedded in the slab between the base surface and the top of the slab. The procedure is that prior to pouring the concrete, the reinforcement is supported above the base surface on an array of chairs so that when the concrete is poured both the reinforcing bars and the chairs become embedded in the slab.

SUMMARY OF THE INVENTION

The invention provides a chair support structure for the purpose described which is simple to manufacture and use, which provides adequate resistance to buckling under loads imposed thereon when the concrete is poured, and which is substantially completely rustproof so that, for example, the feet of the chair if exposed on the undersurface of a precast concrete slab will not be subject to rust.

A chair support structure in accordance with the invention accordingly comprises smaller and larger molded plastic elements each shaped substantially as a letter A with diverging legs, an upper cross member, and a lower cross member, the smaller element being adapted to fit through the opening defined in the larger element between its respective cross members in a tilted condition and then to be swung into an upright position so as to provide locking interengagement between the respective cross members which have interfitting notches for this purpose.

The assembled structure thus provides a stable four-leg support of cruciform shape which is stabilized by a pair of interfitting notch-type connections in the respective cross members. The notch in at least one of the cross members of the larger element may have an angled sidewall to allow the smaller element to be fitted into the opening as aforesaid and then slid across into upright position interengaging the slots in the other set of cross members.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
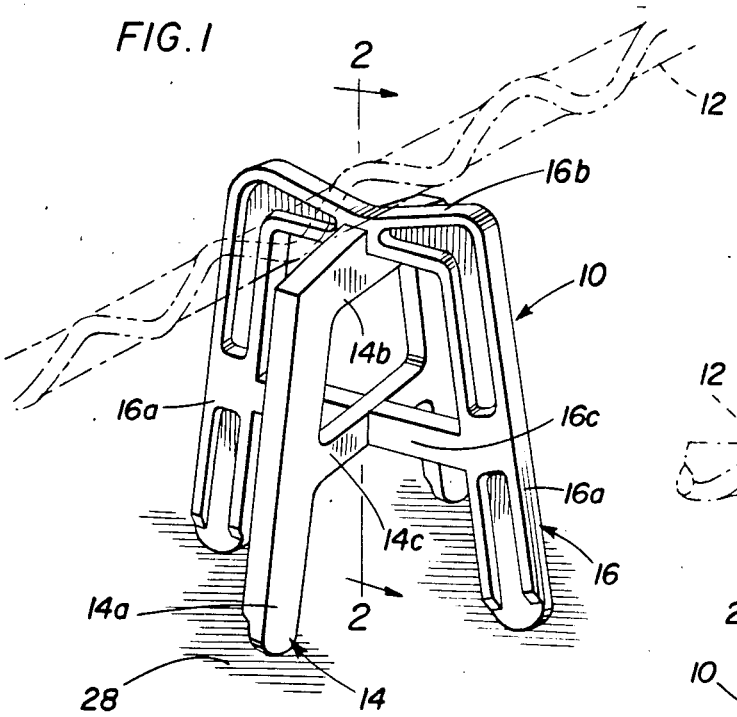
FIG. 1 is a perspective view of a chair support for a reinforcing bar in accordance with the invention.

A chair support structure 10 for a concrete reinforcing bar 12 comprises a smaller element 14 interfitted into a larger similarly shaped element 16. Each of the elements 14 and 16 is molded in a durable plastic and each is generally in the shape of a letter A. Thus, element 14 has diverging legs 14*a*, an upper cross member 14*b*, and a lower cross member 14*c*, while element 16 has similar diverging legs 16*a*, an upper cross member 16*b*, and a lower cross member 16*c*.

The upper cross member 14*b* of element 14 has an upper surface which slopes downwardly towards the ends and is provided with a central notch 18, and the lower cross member 14*c* has a downwardly facing central notch 20. The width of the notches is substantially equal to the thickness of the respective elements 14 and 16. The upper cross member 16*b* of element 16 has an upper surface which slopes downwardly towards center and a downwardly facing central notch 22. The lower cross member 16*c* has an upwardly facing central notch 24 with one edge 24*a* which may be inclined upwardly at about 30 degrees. The elements may be of generally rectangular cross-section with material-saving recesses 26 and the lower ends of the respective legs may be rounded so as to minimize contact on a support surface 28.

Figure 2:
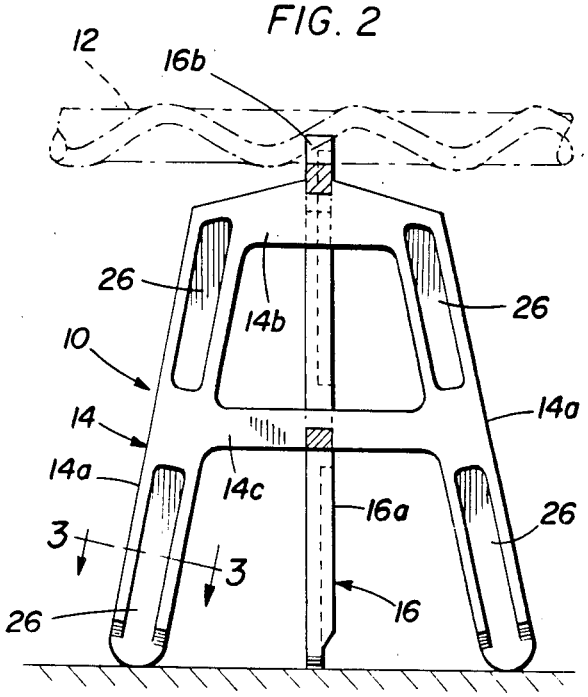
FIG. 2 is a sectional view on line 2—2 of FIG. 1.
Figure 3:
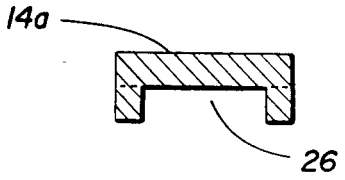
FIG. 3 is an enlarged sectional view on line 3—3 of FIG. 2.
Figure 4:
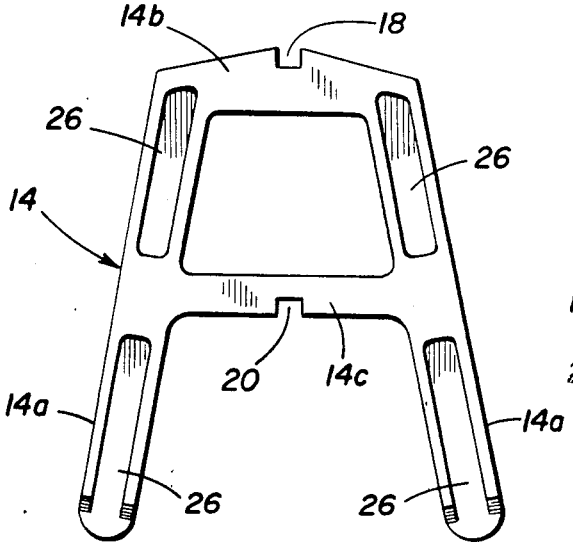
FIG. 4 is an elevational view of a smaller element of the chair support.
Figure 5:
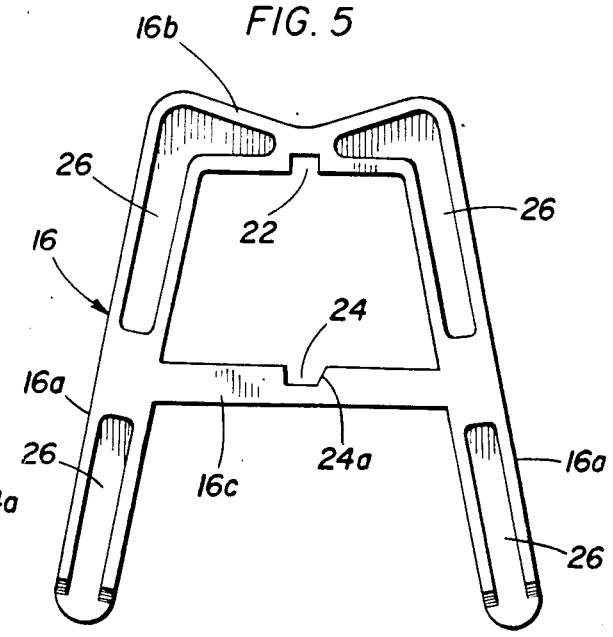
FIG. 5 is an elevational view of a larger element of the chair support.

The respective dimensions of elements 14 and 16 are such that element 14 can be angled through the opening in element 16 between cross members 16*b* and 16*c* in a tilted position with notch 20 inserted in notch 24 and the angle of edge 24*a* allowing for accomodation of element 14. Element 14 can then be swung into vertical alignment so that notch 18 engages in notch 22 as shown in FIGS. 1 and 2. Notch 22 may have one longer side (not shown) which forms a stop for cross member 14*b*. The elements 14 and 16 are thus effectively locked in a stable cruciform configuration with the double interlocking cross members providing support against deformation under vertical loads. The concave upper surface of element 16 provides a convenient seat for the reinforcing bar. It will be seen that when assembled the cross-members 14*c* and 16*c* are substantially flush.

The elements 14 and 16 are simple and economical to manufacture by injecting molding, and are impervious to rust. Further, the structure facilitates shipping in flat disassembled form and it can be readily and simply assembled on site.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A chair support structure for use in supporting a reinforcing bar during a concrete pouring procedure comprising smaller and larger plastic elements each shaped substantially as a letter A with diverging legs, an upper cross member, and a lower cross member, the smaller element being adapted to fit through an opening defined between the cross members of the larger element in a relatively tilted position, and the respective cross members being formed with complementary central notches whereby the smaller element may be swung laterally into vertical position relative to the larger element with the respective notches being interengaged to lock the elements together in a cruciform configuration with the lower cross members preventing the legs from spreading outwardly when supporting a weight.

2. The invention of claim 1 wherein the upper cross member of the smaller element has an upwardly open notch for engagement in a downwardly open notch in the upper cross member of the larger element, wherein the lower cross member of the smaller element has a downwardly open notch for engagement in an upwardly open notch in the lower cross member of the larger element, and wherein one of the notches of the larger element has a sloping edge for providing accommodation of the smaller element in said opening in tilted position.

3. The invention of claim 2 wherein the upper cross member of the larger element has a concave upper surface for locating a reinforcing bar.

4. In combination with a concrete reinforcing bar, a chair support for supporting the bar during a concrete pouring procedure, the chair support comprising smaller and larger molded plastic elements each in the form of a letter A with diverging legs, an upper cross member, and a lower cross member, the smaller element being fitted through an opening in the larger element between the cross members, and the elements being fixed together in mutually perpendicular relation by interengagement between portions of their respective cross members, said elements being fixed together by interlocking notches in the respective cross members, the upper cross member of the smaller element having an upwardly open notch for engagement in a downwardly open notch in the upper cross member of the larger element, the lower cross member of the smaller element having a downwardly open notch for receipt in an upwardly open notch in the lower cross member of the larger element, one of the notches of the larger element having a sloping edge for providing accommodation of the smaller element in said opening in a tilted position prior to interengagement of the respective notches of the upper cross members, the legs of each element having convex feet portions for minimizing contact with a support surface, each element having limbs of substantially rectangular configuration with material-saving recesses provided therein, said upper and lower cross members comprising separate distinct elements which are spaced by an amount sufficient to prevent the legs from spreading outwardly when supporting a weight.

5. A support for use with a reinforcing bar intended for reinforcement of concrete comprising first and second generally planar members, each of said members including an upper cross member and an elongated leg at each end thereof, said legs extending from said upper members in mutually diverging relation, each of said members also including a lower cross member spaced from the upper cross member and connected with the legs generally adjacent a mid-point thereof with all other areas encompassed by the legs and upper cross member being open, the upper cross member and lower cross member on one member having inwardly facing notches, the upper cross member on one member having inwardly facing notches, the upper cross member and the lower cross member on the other member having outwardly facing notches, all of said notches being located adjacent a mid-point of the respective cross members with the notches interengaging when the members are assembled in perpendicular relation to each other by inserting the free end of one leg of the member having outwardly facing notches through the open area above the cross member having an inwardly facing notch and orienting the members in perpendicular relation by pivoting the members laterally in relation to each other thereby preventing lateral tilting of one member in relation to the other and maintaining the free ends of the legs in mutually spaced relation.

* * * * *